US011241710B2

(12) United States Patent
Görtz et al.

(10) Patent No.: US 11,241,710 B2
(45) Date of Patent: Feb. 8, 2022

(54) DEVICE AND METHOD FOR COATING OF A METALLIC STRIP SUBSTRATE ON ONE SIDE AND/OR ON BOTH SIDES

(71) Applicant: SMS group GmbH, Düsseldorf (DE)

(72) Inventors: Henry Görtz, Bergisch Gladbach (DE); Matthias Kretschmer, Cologne (DE); Lutz Kümmel, Jüchen (DE)

(73) Assignee: SMS group GmbH, Düsseldorf (DE)

( * ) Notice: Subject to any disclaimer, the term of this patent is extended or adjusted under 35 U.S.C. 154(b) by 0 days.

(21) Appl. No.: 16/635,615

(22) PCT Filed: Jul. 11, 2018

(86) PCT No.: PCT/EP2018/068809
§ 371 (c)(1),
(2) Date: Jan. 31, 2020

(87) PCT Pub. No.: WO2019/025145
PCT Pub. Date: Feb. 7, 2019

(65) Prior Publication Data

US 2020/0238330 A1 Jul. 30, 2020

(30) Foreign Application Priority Data

Aug. 2, 2017 (DE) ..... 10 2017 213 371.6

(51) Int. Cl.
*B05D 1/06* (2006.01)
*B05C 11/10* (2006.01)
(Continued)

(52) U.S. Cl.
CPC ..... *B05D 1/06* (2013.01); *B05C 9/04* (2013.01); *B05C 11/1005* (2013.01);
(Continued)

(58) Field of Classification Search
None
See application file for complete search history.

(56) References Cited

U.S. PATENT DOCUMENTS 3,248,253 A * 4/1966 Barford ..... B05D 1/24 427/459
3,653,544 A 4/1972 Young et al.
(Continued)

FOREIGN PATENT DOCUMENTS

CN 101293236 A 10/2008
CN 102449429 A 5/2012
(Continued)

*Primary Examiner* — Jethro M. Pence
(74) *Attorney, Agent, or Firm* — Smartpat PLC

(57) ABSTRACT

A device for coating a metal strip substrate includes a guiding apparatus for guiding the strip substrate along a movement path. A first coating apparatus coats a first main side of the strip substrate with an electrostatically charged coating powder which is in a fluidized state. The first coating apparatus is arranged under a first path section of the movement path. A second coating apparatus coats a second main side of the strip substrate with an electrostatically charged coating powder which is in a fluidized state. A redirecting unit redirects the strip substrate between the first and the second coating apparatus in such a way that the strip substrate in a second path section travels oppositely to the strip substrate in the first path section. The second coating apparatus is arranged at least partly geodetically under the second path section.

14 Claims, 1 Drawing Sheet

(51) Int. Cl.

| | |
|---|---|
| ***B05C 19/02*** | (2006.01) |
| ***B05C 9/04*** | (2006.01) |
| ***B05D 3/02*** | (2006.01) |
| ***B05D 7/14*** | (2006.01) |

(52) U.S. Cl.
CPC ..... *B05C 19/025* (2013.01); *B05D 3/0254* (2013.01); *B05D 7/14* (2013.01)

(56) References Cited

U.S. PATENT DOCUMENTS

| | | | | |
|---|---|---|---|---|
| 3,887,720 | A | 6/1975 | Jackson | |
| 5,800,615 | A * | 9/1998 | Lambert | B05B 5/08 118/326 |
| 2002/0119255 | A1 | 8/2002 | Divigalpitiya et al. | |
| 2005/0123777 | A1* | 6/2005 | Maijala | B05D 1/06 428/457 |
| 2006/0150701 | A1* | 7/2006 | Palzer | B21B 37/16 72/205 |
| 2007/0220941 | A1* | 9/2007 | Kleinfeldt | B21B 1/18 72/234 |
| 2012/0076923 | A1 | 3/2012 | Bucher | |

FOREIGN PATENT DOCUMENTS

| | | | |
|---|---|---|---|
| CN | 103818492 | A | 5/2014 |
| CN | 205981127 | U | 2/2017 |
| CN | 106999976 | A | 8/2017 |
| DE | 2231685 | A1 | 1/1973 |
| DE | 102004010177 | A1 | 10/2005 |
| GB | 1357214 | A | 6/1974 |

* cited by examiner

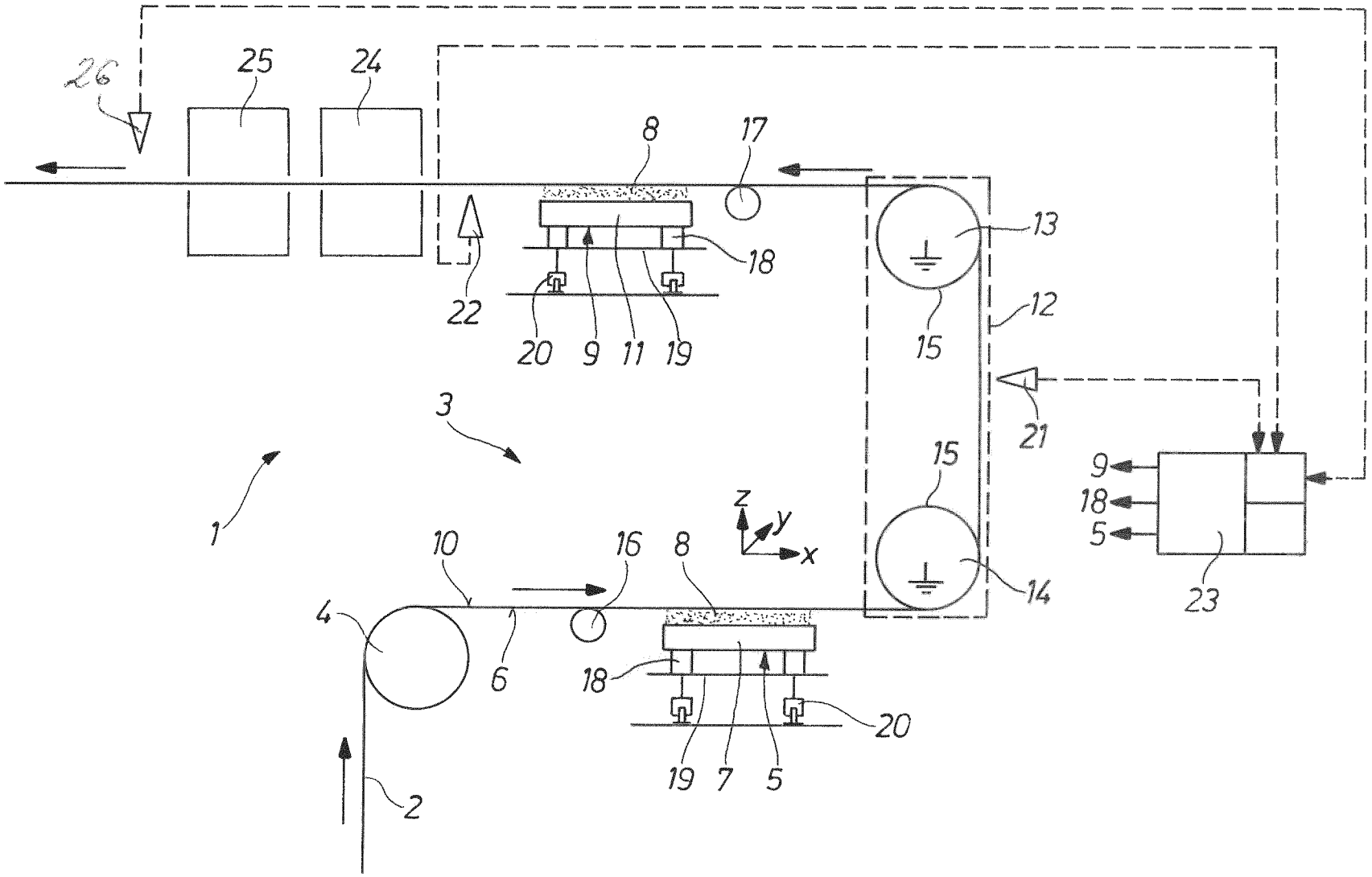
23
9
18
5
21
12
13
14
15
15
20
17
18
8
19
11
9
20
22
24
25
26
3
1
16
6
10
4
2
8
5
7
19
18
x
y
z

DEVICE AND METHOD FOR COATING OF A METALLIC STRIP SUBSTRATE ON ONE SIDE AND/OR ON BOTH SIDES

TECHNICAL FIELD

The invention relates to a device for coating a metallic strip substrate on one side and/or on both sides.

BACKGROUND

A device for coating a metallic strip substrate is known from U.S. Pat. Nos. 3,248,253 A and 3,653,544 A, for example.

It is well-known that metallic strip substrates can be provided with a coating for product refinement or to produce desired product properties. A metallic strip substrate can be provided with a coating on one side or both sides.

For example, the German patent application DE 2 231 685 A1 concerns a method for coating a metallic strip material by: moistening a first surface of the strip material; passing the moistened first surface with a constant predetermined distance over the entire width of the strip material past a first electrostatic device, which is coated with a metal powder such that the moistened first surface is electrostatically provided with an overcoat of the metal coating powder; moistening a second surface located on the opposite side of the strip material; passing the moistened second surface with a constant predetermined distance over the entire width past a second electrostatic device, which is coated with a metallic coating powder such that the moistened second surface is electrostatically provided with an overcoat of the metal coating powder; and drying the moist overcoats on the first and second surfaces and achieving a firm adhesion of the dry overcoats to the surfaces. The latter, predetermined constant distance is maintained by passing the wet overcoat on the first surface of the strip material over at least one support roller with a smooth surface, which is arranged in a manner adjacent to the second electrostatic device.

SUMMARY

One task of the invention is to enable a high-quality, material-saving and continuous coating of a metallic strip substrate.

This task is achieved by the independent patent claims. Advantageous designs are reproduced in the following description, the dependent patent claims and the FIGURE.

A device for coating of a metallic strip substrate on one side and/or on both sides comprises at least one guiding apparatus for guiding the strip substrate during the coating along a predetermined movement path. It further comprises at least one first coating device for coating a first main side of the strip substrate with an electrostatically charged coating powder stored in a fluidized state in a first container. The first container is arranged at least partially geodetically below a first path section of the movement path. Furthermore, the device comprises at least one second coating device for coating a second main side of the strip substrate with an electrostatically charged coating powder stored in a fluidized state in a second container. The second coating device is arranged downstream of the first coating device with respect to a running direction of the strip substrate along the movement path of the first coating device. In addition, the device comprises at least one redirecting unit arranged between the first coating device and the second coating device with respect to the movement path for redirecting the strip substrate. The first path section transitions into a second path section of the movement path by means of the redirecting unit. The redirecting unit redirects the strip substrate in such a manner that the strip substrate in the second path section runs in the opposite direction to the strip substrate in the first path section. The second container is arranged at least partially geodetically below the second path section. In addition, the device has at least one measuring device for the contact-free measurement of a coating thickness produced by the respective coating device. The measuring device is arranged downstream of the respective coating device. At least one stabilizing roller is arranged upstream of at least one coating device. Furthermore, the device has at least one control device connected to the measuring device. The control device controls the operation and/or positioning of at least one coating device and/or the positioning of the stabilizing roller as a function of a target coating thickness and the measurement data generated with the measuring device.

The first and/or the second coating device can be used for coating the strip substrate. Accordingly, the strip substrate can be coated on one side and/or both sides by means of the device for coating of a metallic strip substrate. Each coating device can perform an electrostatic coating of the strip substrate if the respective coating device is activated.

Each coating device can be formed according to the electrostatic fluidizing device in accordance with DE 10 2004 010 177 A1, with which a coating with a very constant coating thickness can be applied to the strip substrate. The first container and the second container can then be formed in a manner corresponding to the fluidizing container in accordance with DE 10 2004 010 177 A1.

In order to be able to fluidize the coating powder stored in the respective container, at least one air supply for introducing fluidizing air into the container can be connected to each container. Above the air supply inlet, a fluidizing floor can be arranged inside the respective container, through which the fluidizing air can be supplied to a volume located above the fluidizing floor and inside the container, in order to fluidize the coating powder. Above the fluidizing bottom of the respective container, electrodes, for example high-voltage electrodes in the form of thin wire electrodes, can be arranged in the volume and inside the container, in order to ionize the fluidizing air.

Thus, a fluidized bed of electrostatically charged, fluidized coating powder can be formed in each container. However, this makes it necessary to arrange the respective container in such a manner that the fluidized coating powder does not flow out of the container. Therefore, the coating of the strip substrate with the coating powder can only be carried out with the respective coating device if the coating device or at least the container containing the fluidized coating powder is arranged partially or completely geodetically below the strip substrate. In this manner, the fluidized coating powder cannot flow out of the container via a container opening arranged on the side of the container turned towards the strip substrate. In order to coat the second main side of the strip substrate with the coating powder, the strip substrate must be redirected with the redirecting unit in such a manner that the second main side is geodetically below the first main side of the strip substrate. In this state, the strip substrate can then be guided past the second coating device, the (second) container of which is arranged partially or completely geodetically below the strip substrate running in the second path section.

The disclosure makes it possible to coat a metallic strip substrate in the area of a continuously operating strip system (strip coil) by means of the device for coating a metallic strip substrate. In particular, it is now possible to use electrostatic powder coating technology after the fluidizing bed process has been carried out in the area of strip substrate refinement in strip systems. The use of a fluidized bed process in the field of the direct and continuous coating of metallic strip substrates is not known from the prior art. The device meets technological requirements regarding strip speed, coating thickness range, product quality and coating direction. In particular, the device can be applied on both sides in one operation, without coating powder transitioning to the main side of the strip substrate which is not to be coated, opposite the respective main side of the strip substrate to be coated. Furthermore, the device for coating a metallic strip substrate does not require any devices in contact with the strip, which could damage the powder coating, which is not yet fixed thermally. Furthermore, with the device, a coating of the metallic strip substrate with a low loss rate of the coating powder can be realized. The device can be used within a coating section of a continuously operating strip coating system (coil). The device enables the application of the advantageous technology of electrostatic powder coating via a fluidized bed process, in order to generally enable powder coating technology in this technical field of continuously operating strip systems, and/or to replace economically and ecologically more disadvantageous wet paint coatings and their use of solvents. Thus, the disclosed device provides the basic prerequisites for the integration and operation of the fluidized bed process in a continuously operating strip coating system.

When designing the disclosed device, large-scale and production requirements for continuously operating strip coating processes can be taken into account, such as the control and predetermined influence on the coating quantity and quality along with the reduction of times for product change, maintenance and cleaning. The device can integrate electrostatic powder coating technology into today's environment of existing wet paint system configurations, either as a technology extension or as a replacement for wet painting or as an application of both technologies in a mixed operation. In addition, the device may replace disadvantageous powder coating technologies, such as the use of coating powder gun applications.

The guiding apparatus for guiding the strip substrate during coating along the predetermined movement path can be formed in such a manner that the strip substrate can be guided horizontally in the first path section and/or the second path section and at a constant, predetermined distance from the respective coating device or with a strip sag above the coating device. The strip sag can be used as a further process-related degree of freedom for the predetermined formation of a curve of the field strength of an electric field between the respective coating device or the fluid bed formed thereby and the strip substrate, wherein the field strength changes continuously over the fluid bed, which has an effect on the coating process and the coating result.

The coating devices can be mechanically and functionally interchangeable units. Based on their respective structural design, the coating devices may alternatively differ from each other in height, width and/or depth.

That the strip substrate in the second path section runs opposite to the strip substrate in the first path section means that the running direction or at least one horizontal component of the running direction of the strip substrate in the first path section is opposite to the running direction or at least one horizontal component of the running direction of the strip substrate in the second path section.

The metallic strip substrate can have a width, for example, in a range of 500 mm to 3000 mm and/or a thickness, for example, in a range of 0.2 mm to 4 mm. The strip substrate can be guided by the guiding apparatus at a strip speed in a range of 5 m/min to 180 m/min, for example.

The positioning of the respective coating device relative to the respective main side of the strip substrate can be achieved by mounting or arranging the coating device in or on a positioning frame or positioning unit of the device. The positioning frame can be movably arranged via a multi-axis linkage, preferably via a three-axis linkage. The positioning of the respective coating device can be varied by tilting, rotating and/or lifting the coating device. Positioning drives, such as motor-driven worm gear screw jacks or rack-and-pinion drives, can be used to move the positioning frame. Due to this mobility of the positioning frame and thus of the coating device arranged on it, an optimal control of the coating uniformity and thickness can be realized by two rotational directions of movement (x- and y-coordinate) along with one translational direction of movement (z-coordinate) of the coating device. The positioning frames assigned to the coating devices can be of identical design, even if the coating devices are of different shapes. The strip substrate has strip substrate sections, each of which is joined together by a stitch seam. The stitch seam represents a disturbance variable, which is why the respective coating device or fluid bed must be removed from the strip substrate to allow the stitch seam to pass through. To minimize strip loss, such movement of the fluid bed must be performed very quickly. This is possible with the positioning drives.

Alternatively or in addition, the distance (z-coordinate) between the strip substrate and the respective coating device can be changed by changing the tensile stress in the strip substrate and thus deliberately predetermining the strip sag contour above the coating device. Alternatively or in addition, the distance of the strip substrate to the respective coating device in the z, x and/or y direction can be changed by positioning drives at all bearing points of components of the guiding apparatus, which are in guiding contact with the strip substrate.

A stabilizing roller can be arranged at least partially geodetically below the respective path section. The stabilizing roller can be used to reduce the strip sag of the strip substrate in front of the respective coating device. In addition, the stabilizing roller can be used to calm or reduce movement distortions of the strip substrate in the running direction in front of the respective electrostatic coating device. For this purpose, the stabilizing roller is in contact with the strip substrate and can thus support the strip substrate from below, for example. The distance between the stabilizing roller and the coating device in the running direction of the strip can be smaller than 20000 mm, for example. Preferably, with respect to the running direction of the strip substrate along the movement path of each coating device, at least one stabilizing roller is installed upstream.

A measuring device can be held in a stationary measuring position in relation to the strip width of the strip substrate. Alternatively, the measuring device can be formed as a measuring device traversing over the strip width of the strip substrate for the dynamic recording of the coating thickness, in order to enable statements to be made regarding the longitudinal and transverse profile of the coating result on a main side of the strip substrate. The measuring device can be assigned to the sensor class of beta backscatter, X-ray fluorescence, infrared or advanced thermal optics. Preferably, the device comprises a measuring device downstream of each coating device, such that the measurements of the respective coating thicknesses on the two main sides of the strip substrate are possible separately and independently for the first and the second main side.

A control device processes the measured data of the measuring device or measuring devices, wherein deviations of the measured coating thickness from the target coating thickness can act on the above-mentioned positioning drives via a control algorithm and a control signal generated thereby, in order to be able to adjust the positioning of the at least one coating device. In this manner, for example, deviations from a longitudinal and/or transverse profile target value of the coating thickness of the respective powder coating can be corrected. Alternatively or in addition, the control signal for correcting the respective coating thickness deviation can act on the amount of the electrical voltage applied to the electrodes of the respective coating device used for electrostatic charging the fluidized coating powder. The mass flow of powder coating transferred from the respective coating device to the strip substrate depends on the field strength of an electric field between the fluid bed formed by the coating device and the strip substrate. The field strength can be varied via the fluid bed or its power supply. At constant voltage and strip speed, a change in the distance between the fluid bed and the strip substrate creates a further process control variable for the flow rate of powder coating. This change in distance can be achieved by solely changing the position of the coating device or the fluid bed. Alternatively or in addition, the change in distance can be effected by lifting or lowering the strip substrate above the coating device or the fluid bed, as the case may be. For lifting and lowering the strip substrate, the tensile stress of the strip and/or the positioning of the strip substrate can be varied by means of the respective stabilizing roller.

The device for coating a metallic strip substrate may be equipped with a quick-change locking mechanism between the respective positioning frame and the respective coating device, which enables an operator to manually exchange the coating device located in or on the positioning frame for another provided coating device in the shortest possible time.

In accordance with an advantageous design, the redirecting unit comprises two redirecting rollers. This allows the distance between the first path section and the second path section to be increased compared to the use of a single redirecting roller, in order to provide sufficient space for the second coating device between the two path sections of the moving path. Alternatively, the redirecting unit may comprise a single redirecting roller, the outer diameter of which is preferably selected to be so large that sufficient installation space for the second coating device can be provided between the two path sections. Alternatively, the redirecting unit can have three or more redirecting rollers.

An additional advantageous design provides that at least one redirecting roller has an electrically grounded roller shell. The strip substrate is thus connected to a ground potential via an electrically conductive surface contact with the redirecting roller. Through this grounding of the strip substrate, electrostatic forces act between the strip substrate and the coating powder, causing the coating powder to move towards the strip substrate and adhere electrostatically to it. All redirecting rollers of the redirecting unit can also have an electrically grounded roller shell.

In accordance with an additional advantageous design, at least one coating device is arranged so that it can be moved between a functional position and a rest position. In order to achieve a minimal operating and changing effort in terms of time, the coating device with its respective positioning frame described above, driven manually or by motor, can be moved out of or into the strip system by the operating personnel via a rail-guided traversing frame. The length of the travel path of the coating device or positioning frame from the functional position to the rest position can be such that, in the functional position, a surface of the coating device projected in the z-direction symmetrically covers the width of the strip substrate and, in the rest position, such projected surface is located completely outside the system safety area and completely in the working zone of the operating personnel. The direction of travel can be lateral, for example at an angle of 90° to the direction of travel of the strip substrate. The positioning time of the positioning drives for moving the respective coating device in the z-direction from the functional position or coating position to the rest position and vice versa can be, for example, one second.

An additional advantageous design provides that the device has at least one application device for applying a wet coating to the strip substrate. This allows a strip substrate to be coated with a wet coating medium as an alternative or addition to the electrostatic coating. In this connection, the coating devices and the application device can be arranged so as to be movable between functional positions and rest positions, wherein the movement of at least one coating device into its rest position can be coupled in one operation and simultaneously with the movement of the application device into its functional position, and vice versa. At least one coating device can be installed on a transport system together with the application device. The application device can be formed as a roller application system for wet paint ("roll coater"), which has at least one application roller and at least one counter roller, between which the strip substrate passes.

Advantageously, at least one redirecting roller is a counter roller of the application device. Accordingly, the redirecting roller can be a counter roller of a roller application system for wet paint. Due to the double function assignment of the redirecting roller, the structure of the device can be simplified.

In accordance with an additional advantageous design, the device comprises at least one continuous strip furnace downstream of the second coating device for heat treating the coated strip substrate. In the continuous strip furnace, the powder coating applied to one or both sides of the strip substrate can be subjected to a heat treatment to form a closed coating film and/or its layer properties. For the heat transfer to the strip substrate coating, the continuous strip furnace can have radiant heat sources arranged above and below the strip substrate plane to transfer heat to both sides of the strip substrate coating. Radiant heat sources can be, for example, those emitting in the infrared spectrum (NIR, IR, dark radiators) in the wavelength range from 1.0 μm to 5.0 μm or a UV spectrum <0.4 μm. Preferably, the continuous strip furnace does not contain any devices in contact with the strip or is not in contact with the coated strip substrate. In particular, the main sides of the strip substrate can be guided without contact, starting with the entry of the strip substrate into the respective coating device and ending at least at the exit of the strip substrate from the continuous strip furnace. The continuous strip furnace can be used either exclusively to achieve the desired final product properties of the coated strip substrate or, in combination with an additional downstream continuous strip furnace, only a partial process step of gelation (transfer of the powder coating from the solid or powdery physical state into a melt-viscous liquid state). In the latter case, the final product properties of the coated strip substrate can be formed in the additional continuous strip furnace. The continuous strip furnace can be designed as a convection furnace, for example. For this purpose, a melting furnace can be installed upstream of the convection furnace. This can also be an induction furnace in addition to IR. Alternatively to a continuous strip furnace, the heating of the strip substrate coating can also be carried out indirectly via the inductive longitudinal or transverse field heating of the strip substrate. In particular, the continuous strip furnace can be a suspended or sagging furnace. The continuous strip furnace can be used for melting, melting and final heating or only for final heating.

It is also advantageous if the device has at least one measuring sensor arranged downstream of the continuous strip furnace for detecting at least one product property of the coated strip substrate. With the measuring sensor, at least one coating result can be detected after heat treatment by means of the continuous strip furnace. The measuring sensor can be assigned to the sensor class of beta backscatter, X-ray fluorescence, infrared or advanced thermal optics. The measuring sensor can be located between the exit of the first coating device and before the entry of the strip substrate into the continuous strip furnace, with reference to the running direction of the strip substrate. Preferably, the device comprises a measuring sensor with which the coating result can be detected on the first main side of the strip substrate, and a measuring sensor with which the coating result can be detected on the second main side of the strip substrate. The measuring data of the measuring sensor(s) can also be fed to the control device or a control algorithm and processed by it.

In accordance with a method for coating of a metallic strip substrate on one side and/or on both sides, the strip substrate is guided along a predetermined movement path during the coating process, a first main side of the strip substrate is coated with an electrostatically charged coating powder stored in a fluidized state in a first coating device that is arranged at least partially geodetically below a first path section of the movement path, the strip substrate is redirected at the end of the first path section in the direction of a second path section of the movement path in such a manner that the strip substrate in the second path section runs in the opposite direction to the strip substrate in the first path section, and a second main side of the strip substrate is coated with an electrostatically charged coating powder stored in a fluidized state in a second coating device that is arranged at least partially geodetically below a second path section. In accordance with the method in accordance with the invention, a coating thickness produced by means of the first and/or second coating device is also detected without contact, wherein the operation and/or positioning of at least one coating device and/or the distance between the strip substrate and the respective coating device is controlled by varying a tensile stress in the strip substrate as a function of a target coating thickness and the respective detected coating thickness.

The method has the advantages specified above in relation to the device. In particular, the device may be used in accordance with one of the aforementioned designs or any technically reasonable combination of at least two of such designs with each other, in order to carry out the method.

By varying the tensile stress in the strip substrate, the strip sag or the strip sag contour of the strip substrate above the respective coating device or the distance between the strip substrate and the respective coating device can be changed.

An additional advantageous design provides for the coated strip substrate to be subjected to heat treatment. For this purpose, at least one heat treatment furnace, in particular a non-contact continuous strip furnace, may be used as described above with reference to the device. Heat treatment can be used to form the desired final product properties of the coated strip substrate.

In the following, the invention will be explained by reference to the attached FIGURE by means of a preferred embodiment, wherein the features explained below may represent an advantageous or additional forming aspect of the invention, both on their own and in different technically useful combinations.

BRIEF DESCRIPTION OF THE DRAWINGS

FIG. 1 shows a schematic representation of an exemplary embodiment for a device for coating a metallic strip substrate.

DETAILED DESCRIPTION

FIG. 1 shows a schematic representation of an exemplary embodiment for a device 1 for coating a metallic strip substrate 2 on one side and/or on both sides.

The device 1 comprises a guiding apparatus 3 for guiding the strip substrate 2 during coating along a predetermined movement path. The strip substrate 2 runs along the movement path according to the arrows arranged along the movement path. The guiding apparatus 3 comprises a redirecting roller 4, which redirects the vertically incoming strip substrate 2 into a horizontally running first path section of the movement path.

Furthermore, the device 1 comprises a first coating device 5 for coating a first main side 6 of the strip substrate 2 with an electrostatically charged coating powder 8 fluidized in a first container 7. The first coating device 5 or the first container 7 is arranged at least partially geodetically below a first path section of the movement path.

In addition, the device 1 comprises a second coating device 9 for coating a second main side 10 of the strip substrate 2 with an electrostatically charged coating powder 8 stored in a fluidized state in a second container 11. The second coating device 9 is downstream of the first coating device 5 with respect to the direction of travel of the strip substrate 2 along the movement path of the first coating device 5.

The device 1 further comprises a redirecting unit 12 for redirecting the strip substrate 2, which is arranged between the first coating device 5 and the second coating device 9 with respect to the movement path. The first path section passes over the redirecting unit 12 into a second path section of the movement path. The first path section thus extends from the redirecting roller 4 to the redirecting unit 12. The redirecting unit 12 redirects the strip substrate 2 in such a manner that the strip substrate 2 in the second path section runs in the opposite direction to the strip substrate 2 in the first path section. The second coating device 9 or the second container 11 is arranged at least partially geodetically below the second path section. The redirecting unit 12 comprises two redirecting rollers 13 and 14, which are arranged in series and at a distance from each other in the height direction (Z-direction), each of which has an electrically grounded roller shell 15.

Each coating device 5 or 9 is preceded by a stabilizing roller 16 or 17, which is arranged at least partially geodetically below the respective path section. If the strip substrate 2 is not coated by means of the first coating device 5, the stabilizing roller 17 may alternatively be positioned above the path section preceding the second coating device 9. Thereby, the stabilizing roller 17 can be moved by means of an adjusting device (not shown) to a position geodetically above or below the path section. This provides an additional process variable for the predetermined influencing of the powder coating thickness.

Each coating device 5 or 9 is arranged to be movable between the functional position (shown) and a rest position (not shown). For this purpose, each coating device 5 or 9 is arranged on a positioning frame 18, which can be moved transversely to the strip running direction via a rail-guided traversing frame 19 with rail-guided rollers 20, or linear guides. Each positioning frame 18 allows the position of the respective coating device 5 or 9 to be varied in the x-, y- and/or z-direction, in order to be able to vary the position of the respective coating device 5 or 9 relative to the strip substrate 2.

The device 1 also comprises a measuring device 21 for the contact-free measurement of the coating thickness produced by the first coating device 5. The measuring device 21 is arranged downstream of the first coating device 5 and is arranged between the redirecting rollers 13 and 14 of the redirecting unit 12. In addition, the device 1 comprises a measuring device 22 for the contact-free measurement of the coating thickness produced by the second coating device 9. The measuring device 22 is arranged downstream of the second coating device 5.

The device 1 comprises a control device 23 connected to the measuring devices 21 and 22, which controls the operation of the first coating device 5, the second coating device 9 and the positioning frames 18 as a function of a target coating thickness and the measurement data generated by the measuring devices 21 and 22.

The device 1 may have at least one application device (not shown) for applying a wet coating to the strip substrate 2. At least one of the redirecting rollers 13 and 14 can be a counter roller of the application device.

Furthermore, the device 1 comprises two contact-free continuous strip furnaces 24 and 25, which are arranged downstream of the second coating device 9, for the heat treatment of the coated strip substrate 2. The measuring device 22 is arranged between the heat treatment furnace 24 and the second coating device 9.

The device 1 can also have at least one measuring sensor 26 arranged downstream of the continuous strip furnace 25 for detecting at least one product property of the coated strip substrate 2. This measuring sensor 26 is also connected to the control device 23.

LIST OF REFERENCE SIGNS

1 Device
2 Strip substrate
3 Guiding apparatus
4 Redirecting roller
5 First coating device
6 First main side of 2
7 Container of 5
8 Coating powder
9 Second coating device
10 Second main side of 2
11 Container of 9
12 Redirecting unit
13 Redirecting roller of 12
14 Redirecting roller of 12
15 Roller shell
16 Stabilizing roller
17 Stabilizing roller
18 Positioning frame
19 Traversing frame
20 Roller of 19
21 Measuring device
22 Measuring device
23 Control device
24 Continuous strip furnace
25 Continuous strip furnace
26 Measuring sensor

The invention claimed is:

1. A device for coating a metallic strip substrate, comprising:

at least one guiding apparatus for guiding the strip substrate during the coating along a predetermined movement path;

at least one first coating device for coating a first main side of the strip substrate with electrostatically charged coating powder stored in a fluidized state in a first container, the first container being arranged at least partially geodetically below a first path section of the movement path;

at least one second coating device for coating a second main side of the strip substrate with electrostatically charged coating powder stored in a fluidized state in a second container, the second coating device being arranged downstream of the first coating device with respect to a running direction of the strip substrate along the movement path of the first coating device;

at least one redirecting unit arranged between the first coating device and the second coating device with respect to the movement path for redirecting the strip substrate, wherein the first path section transitions into a second path section of the movement path by means of the redirecting unit, wherein the redirecting unit redirects the strip substrate in such a manner that the strip substrate in the second path section runs in the opposite direction to the strip substrate in the first path section, and wherein the second container is arranged at least partially geodetically below the second path section;

a measuring device for contact-free measurement of a coating thickness produced by the first coating device or the second coating device, the measuring device being arranged downstream of the respective coating device;

at least one stabilizing roller arranged upstream of the at least one first coating device or the at least one second coating device; and at least one control device connected to the measuring device, which controls an operation and/or positioning of at least one coating device and/or a positioning of the stabilizing roller as a function of a target coating thickness and measurement data generated by the measuring device.

2. The device according to claim 1, wherein the redirecting unit has two redirecting rollers.

3. The device according to claim 2, wherein at least one of the two redirecting rollers has an electrically grounded roller shell.

4. The device according to claim 1, wherein the at least one first coating device or the at least one second coating device is arranged so that it can be moved between a functional position and a rest position.

5. The device according to claim 1, further comprising at least one continuous strip furnace downstream of the second coating device for heat treating the coated strip substrate.

6. The device according to claim 5, further comprising at least one measuring sensor arranged downstream of the continuous strip furnace for detecting at least one product property of the coated strip substrate.

7. The device according to claim 1, wherein the at least one first coating device is arranged on a first movable positioning frame and/or wherein the at least one second coating device is movably arranged on a second movable positioning frame.

8. The device according to claim 7, wherein the control device adjusts the positioning of the at least one first coating device and/or the at least one second coating device.

9. The device according to claim 1, wherein the control device controls a positioning of the stabilizing roller.

10. The device according to claim 1, wherein a distance between the strip substrate and the at least one first coating device can be changed by changing a tensile stress in the strip substrate.

11. The device according to claim 1, wherein the control device controls a voltage applied to electrodes of the at least one first coating device.

12. The device according to claim 1, wherein the at least one stabilizing roller is arranged downstream of a material feed.

13. The device according to claim 1, wherein the at least one stabilizing roller reduces sag of the strip.

14. A device for coating a metallic strip substrate, comprising:

a guiding apparatus for guiding the strip substrate during the coating along a predetermined movement path;

a first coating device for coating a first main side of the strip substrate with electrostatically charged coating powder stored in a fluidized state in a first container, the first container being arranged at least partially geodetically below a first path section of the movement path;

a second coating device for coating a second main side of the strip substrate with electrostatically charged coating powder stored in a fluidized state in a second container, the second coating device being arranged downstream of the first coating device with respect to a running direction of the strip substrate along the movement path of the first coating device;

a redirecting unit arranged between the first coating device and the second coating device with respect to the movement path for redirecting the strip substrate, wherein the first path section transitions into a second path section of the movement path by means of the redirecting unit, wherein the redirecting unit redirects the strip substrate in such a manner that the strip substrate in the second path section runs in the opposite direction to the strip substrate in the first path section, and wherein the second container is arranged at least partially geodetically below the second path section;

a measuring device for contact-free measurement of a coating thickness produced by the first coating device or the second coating device, the measuring device being arranged downstream of the respective coating device;

a first stabilizing roller arranged upstream of the first coating device;

a second stabilizing roller arranged upstream of the second coating device; and a control device connected to the measuring device, which controls at least one of an operation of the first coating device, an operation of the second coating device, a positioning of the first coating device, a positioning of the second coating device, a positioning of the first stabilizing roller, and a positioning of the second stabilizing roller as a function of a target coating thickness and measurement data generated by the measuring device.

* * * * *